US008203436B2

(12) United States Patent
Ikeda

(10) Patent No.: US 8,203,436 B2
(45) Date of Patent: Jun. 19, 2012

(54) REMOTE CONTROLLER FOR ENABLING AN OPERATION COMMAND TO BE OBTAINED FROM AN ELECTRONIC APPARATUS AND SET INTO AN OPERATION KEY, REMOTE CONTROL SYSTEM HAVING SAID REMOTE CONTROLLER, AND REMOTE CONTROL METHOD PERTAINING THERETO

(75) Inventor: Yasuhisa Ikeda, Chiba (JP)

(73) Assignee: Sony Corporation (JP)

( * ) Notice: Subject to any disclaimer, the term of this patent is extended or adjusted under 35 U.S.C. 154(b) by 988 days.

(21) Appl. No.: 12/221,667

(22) Filed: Aug. 5, 2008

(65) Prior Publication Data

US 2009/0040016 A1 Feb. 12, 2009

(30) Foreign Application Priority Data

Aug. 10, 2007 (JP) ..... P2007-209226

(51) Int. Cl.
*G08B 21/00* (2006.01)

(52) U.S. Cl. ..... 340/12.28; 340/4.11; 340/5.22; 340/12.22; 340/12.23; 341/176; 348/734

(58) Field of Classification Search ..... 340/4.11, 340/4.34, 4.42, 5.22, 12.22, 12.23, 12.28, 340/13.24, 13.31, 13.21, 3.7, 3.71; 341/175, 341/176; 398/114; 345/156, 167; 348/734
See application file for complete search history.

(56) References Cited

U.S. PATENT DOCUMENTS 5,959,539 A * 9/1999 Adolph et al. ..... 340/3.5
6,160,491 A * 12/2000 Kitao et al. ..... 340/12.28
2003/0189509 A1* 10/2003 Hayes et al. ..... 341/176
2004/0189508 A1* 9/2004 Nguyen ..... 341/176
2005/0256590 A1 11/2005 Choi

FOREIGN PATENT DOCUMENTS

| | | | |
|---|---|---|---|
| JP | 2000-134681 | A | 5/2000 |
| JP | 2000-194538 | A | 7/2000 |
| JP | 2004-320209 | A | 11/2004 |
| JP | 2005-515674 | A | 5/2005 |
| JP | 2005-184584 | A | 7/2005 |
| JP | 2005-191695 | A | 7/2005 |
| JP | 2006-197377 | A | 7/2006 |
| JP | 2007-116484 | A | 5/2007 |
| JP | 2007-181068 | A | 7/2007 |
| JP | 2008-311958 | A | 12/2008 |

* cited by examiner

*Primary Examiner* — Toan N Pham
*Assistant Examiner* — Mark Rushing
(74) *Attorney, Agent, or Firm* — Lerner, David, Littenberg, Krumholz & Mentlik, LLP

(57) ABSTRACT

A remote controller for operating another apparatus has: an operating unit having operation keys to which different key numbers have been allocated and with which operation commands for operating the another apparatus have been associated; a transmitting/receiving unit for communicating with the another apparatus by bidirectional radio communication; a memory to store the operation commands; and a control unit for reading out the operation command according to the executed operation and transmitting the operation command to the another apparatus. The control unit forms a request signal for requesting code information including a key number and the operation command, transmits it to the another apparatus, receives the code information corresponding to the request signal, and stores the operation command into the memory so as to be associated with the operation key.

7 Claims, 12 Drawing Sheets

REMOTE CONTROLLER FOR ENABLING AN OPERATION COMMAND TO BE OBTAINED FROM AN ELECTRONIC APPARATUS AND SET INTO AN OPERATION KEY, REMOTE CONTROL SYSTEM HAVING SAID REMOTE CONTROLLER, AND REMOTE CONTROL METHOD PERTAINING THERETO

CROSS-REFERENCE TO RELATED APPLICATIONS

The present application claims priority from Japanese Patent Application No. JP 2007-209226, filed in the Japanese Patent Office on Aug. 10, 2007, the entire content of which is incorporated herein by reference.

BACKGROUND OF THE INVENTION

1. Field of the Invention

The invention relates to a remote controller, a remote control system, and a remote control method for remote-operating a plurality of electronic apparatuses.

2. Description of the Related Arts

Hitherto, a remote controller (hereinbelow, properly referred to as a "remocon") has widely been used as a user interface for operating an electronic apparatus. A remocon code as a control code for controlling the operation of the electronic apparatus has previously been stored in a memory built in the remocon. When the user operates the remocon, the remocon code is read out of the built-in memory and a control signal is transmitted to the electronic apparatus.

Generally, since one remocon is necessary for one electronic apparatus, it is considered that a plurality of remocons exist in a home where various electronic apparatuses are used. Therefore, the user has to selectively use the remocons in accordance with the electronic apparatus which he wants to operate, so that it is very inconvenient.

In recent years, therefore, a multi-remote controller (hereinbelow, properly referred to as a "multi-remocon") which can operate a plurality of electronic apparatuses such as television (TV) receiver, VTR (Video Tape Recorder), audio amplifier, DVD (Digital Versatile Disc) player, and the like has been manufactured as a product.

As shown in FIG. 1, a code list in which remocon codes corresponding to a number of electronic apparatuses were described has previously been stored in a memory built in the multi-remocon. When the electronic apparatus is made to correspond to the multi-remocon, the user selects the remocon code corresponding to the electronic apparatus to be used from the code list stored in the built-in memory, so that he can operate the electronic apparatus.

Specifically speaking, for example, a code number of four digits has been made to correspond to the remocon code. When the electronic apparatus is made to correspond to the multi-remocon, the user inputs a code number by operating the multi-remocon, so that the remocon code corresponding to the input code number is read out of the built-in memory and an operation command corresponding to each operation key is set.

As a communication standard between the multi-remocon and the electronic apparatus, for example, an SIRCS (Serial Infrared Remote Control System) can be used. As shown in FIGS. 2A to 2C, code information which is used in the SIRCS includes: a guide pulse indicative of a head of the code information; a data code in which an operation command as electronic apparatus controlling data associated with each operation key has been described; and a category code showing a category of the electronic apparatus. The number of bits of the category code differs depending on, for example, a manufacturing year of the electronic apparatus. There are a category code constructed by 5 bits as shown in FIG. 2A, a category code constructed by 8 bits as shown in FIG. 2B, and a category code constructed by 13 bits as shown in FIG. 2C.

When the user presses a predetermined operation key provided for the multi-remocon, the operation command designated by the data code to the electronic apparatus designated by the category code is transmitted to the electronic apparatus, so that he can operate the electronic apparatus.

Among the multi-remocons, there is also a learning remocon having such a learning function that if a remocon code corresponding to the desired electronic apparatus does not exist on the code list stored in the built-in memory, a light-emission code is received by infrared rays emitted from the remocon serving as a source and analyzed, and the analyzed remocon code is stored into the built-in memory.

However, according to such a multi-remocon in the related art, since it is necessary to previously store the code list corresponding to a number of electronic apparatuses and to newly store the remocon code corresponding to the electronic apparatus which does not exist on the code list, there is such a problem that the built-in memory having a large storage capacity is necessary.

According to the learning remocon, since the new remocon code is obtained on the basis of the light-emission code emitted from the remocon serving as a source, the source remocon is necessary. Further, it is difficult to cope with unknown remocon codes.

To solve the above-mentioned problem, therefore, in recent years, there has been manufactured such a multi-remocon, as a product, that it is connected from a PC to a network such as Internet or the like, the user downloads a remocon code corresponding to the electronic apparatus which the user wants to operate and installs the remocon code into the remocon, so that he can operate the desired electronic apparatus. In such a remocon, since it is sufficient to store only the remocon code corresponding to the desired electronic apparatus, the capacity of the built-in memory provided for the remocon can be reduced. Since the remocon code is obtained through the network, the source remocon is unnecessary.

The method whereby the remocon code corresponding to the desired electronic apparatus is obtained from the PC through the network such as Internet or the like and installed into the remocon has been disclosed in Patent Document 1 (JP-A-2007-116484).

SUMMARY OF THE INVENTION

However, in the case of using the foregoing method disclosed in the above Patent Document 1, since only the remocon codes existing on the network can be obtained, there is such a problem that there is a risk that it is difficult to obtain the remocon codes corresponding to the electronic apparatus just after the sales, the old electronic apparatus, and the like. It is necessary for the user to have a skill enough to access the network by operating the PC and the setting operation of the remocon codes becomes complicated.

Further, there is also such a problem that besides communicating means for controlling the electronic apparatus, another communicating means for communicating with the PC is additionally necessary, software for edition in the PC is also necessary, and the large costs are necessary.

It is, therefore, desirable to provide a remote controller, a remote control system, and a remote control method in which a remocon code of an electronic apparatus serving as an operation target can be easily set.

According to an embodiment of the present invention, there is provided a remote controller for operating another apparatus, comprising: an operating unit having a plurality of operation keys to which different key numbers have been allocated and with which operation commands for operating the another apparatus have been associated; a transmitting/receiving unit configured to communicate with the another apparatus by radio communication which can make bidirectional communication; a storing unit configured to store the operation commands associated with the operation keys; and a control unit configured to read out the operation command according to the operation executed to the operating unit from the storing unit and transmit the operation command to the another apparatus through the transmitting/receiving unit, wherein the control unit forms a request signal for requesting code information including a key number allocated to a predetermined one of the operation keys and the operation command which has been made to correspond to the key number, transmits the request signal to the another apparatus through the transmitting/receiving unit, receives the code information corresponding to the request signal from the another apparatus through the transmitting/receiving unit, and allows the operation command to be associated with the operation key to which the same key number as the key number included in the code information has been allocated and allows the operation command to be stored into the storing unit.

According to another embodiment of the present invention, there is provided a remote control system comprising: a remote controller having an operating unit having a plurality of operation keys to which different key numbers have been allocated and with which operation commands for operating another apparatus have been associated, a first transmitting/receiving unit configured to communicate with the another apparatus by radio communication which can make bidirectional communication, a first storing unit configured to store the operation commands associated with the operation keys, and a first control unit configured to read out the operation command according to the operation executed to the operating unit from the first storing unit and transmit the operation command to the another apparatus through the first transmitting/receiving unit; and an electronic apparatus having a second transmitting/receiving unit configured to communicate with the another apparatus by the radio communication which can make the bidirectional communication, a second storing unit configured to store code information including a predetermined key number and the operation command which has been made to correspond to the key number, and a second control unit configured to control each of the units so as to execute an operation according to the operation command received from the another apparatus through the second transmitting/receiving unit, wherein when the remote controller and the electronic apparatus are connected by the first and second transmitting/receiving units, the remote controller forms a request signal for requesting the code information and transmits the request signal to the electronic apparatus, the electronic apparatus reads out the code information corresponding to the request signal from the second storing unit on the basis of the request signal received from the remote controller and transmits the code information to the remote controller, and the remote controller allows the operation command to be associated with the operation key to which the same key number as the key number included in the code information received from the electronic apparatus has been allocated and allows the operation command to be stored into the first storing unit.

According to still another embodiment of the present invention, there is provided a remote control method whereby when a remote controller configured to store operation commands associated with operation keys into a first storing unit, read out the operation command, from the first storing unit, corresponding to an operation executed to an operating unit having a plurality of operation keys to which different key numbers have been allocated and with which operation commands for operating another apparatus have been associated, and transmit the operation command to the another apparatus through a first transmitting/receiving unit which communicates therewith by radio communication which can make bidirectional communication and an electronic apparatus configured to store code information including a predetermined key number and the operation command which has been made to correspond to the key number into a second storing unit and control each of the units so as to execute an operation corresponding to the operation commands received from the another apparatus through a second transmitting/receiving unit which communicates therewith by the radio communication which can make the bidirectional communication are connected by the first and second transmitting/receiving units, the remote controller forms a request signal for requesting the code information and transmits the request signal to the electronic apparatus, the electronic apparatus reads out the code information corresponding to the request signal from the second storing unit on the basis of the request signal received from the remote controller and transmits the code information to the remote controller, and the remote controller allows the operation command to be associated with the operation key to which the same key number as the key number included in the code information received from the electronic apparatus has been allocated and allows the operation command to be stored into the first storing unit.

According to the embodiments of the invention, when the remote controller and the electronic apparatus are connected by the first and second transmitting/receiving units, the remote controller forms the request signal for requesting the code information and transmits the request signal to the electronic apparatus, the electronic apparatus reads out the code information corresponding to request signal from the second storing unit on the basis of the request signal received from the remote controller and transmits the code information to the remote controller, and the remote controller receives the code information, allows the operation command to be associated with the operation key to which the same key number as the key number included in the code information received from the electronic apparatus has been allocated. Therefore, the proper operation command is set into each operation key.

According to the embodiments of the invention, since the communication is made between the remote controller and the electronic apparatus, the operation command is directly obtained from the electronic apparatus, and the operation command is set into each operation key, there are such advantages that another device or the like for setting the operation command is unnecessary and the operation command can be easily set without setting an erroneous operation command into each operation key.

According to the embodiments of the invention, since the operation command is received from the electronic apparatus and the received operation command is set into each operation key, there are such advantages that it is sufficient that the memory having the capacity corresponding to the number of operation keys which can be set is prepared for the remote controller and the capacity of the built-in memory can be suppressed.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Figure 1:
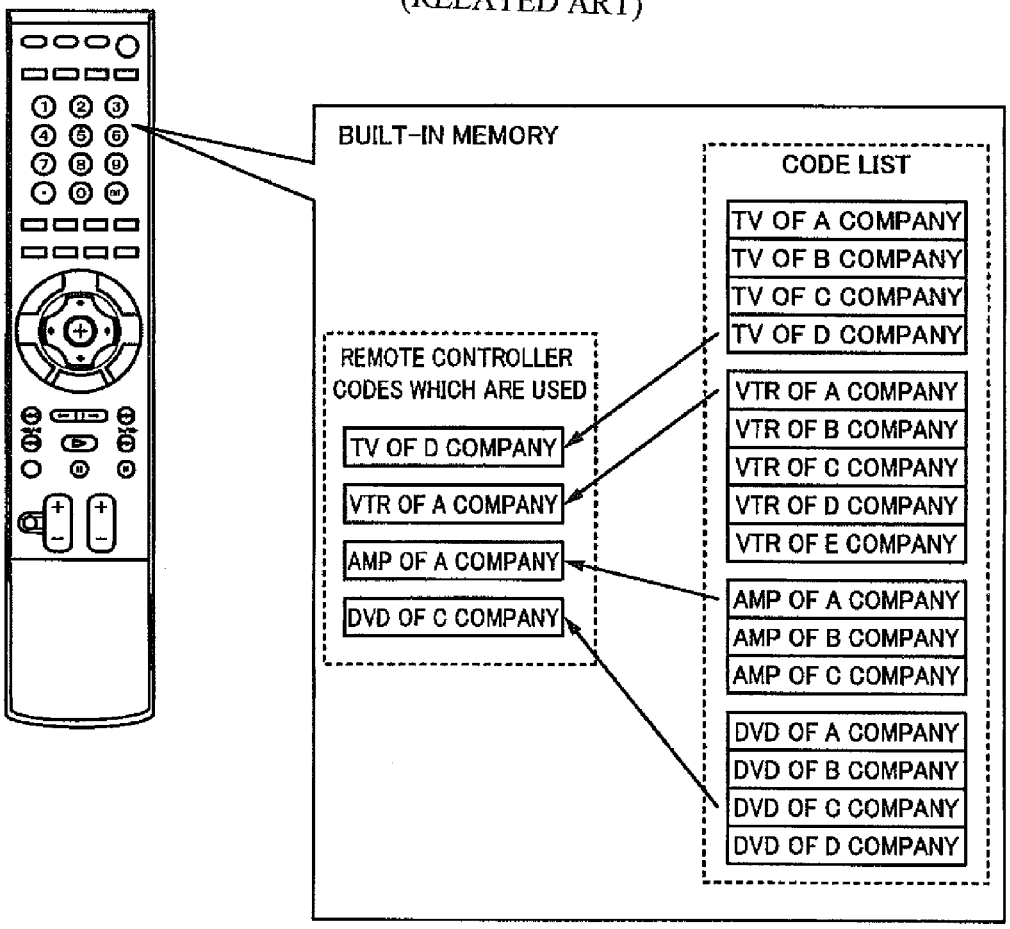
Fig. 1 (RELATED ART)
FIG. 1 is a schematic diagram for explaining the setting of a remocon code in a multi-remocon in the related art.
Figure 2A:
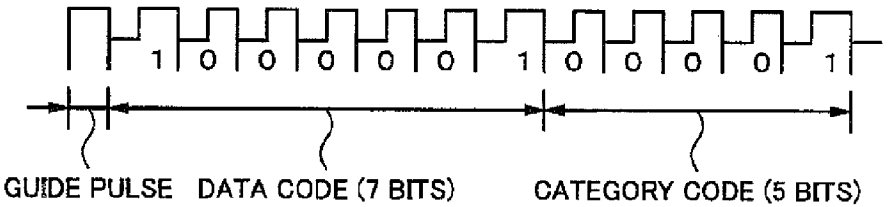
Fig. 2A (RELATED ART)
FIGS. 2A, 2B, and 2C are schematic diagrams for explaining code information in the related art.
Figure 2B:
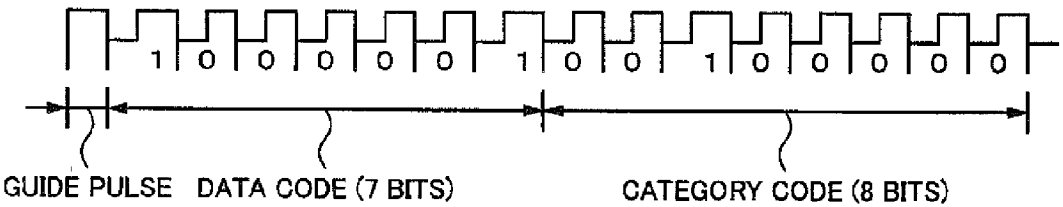
Fig. 2B (RELATED ART)
Figure 2C:
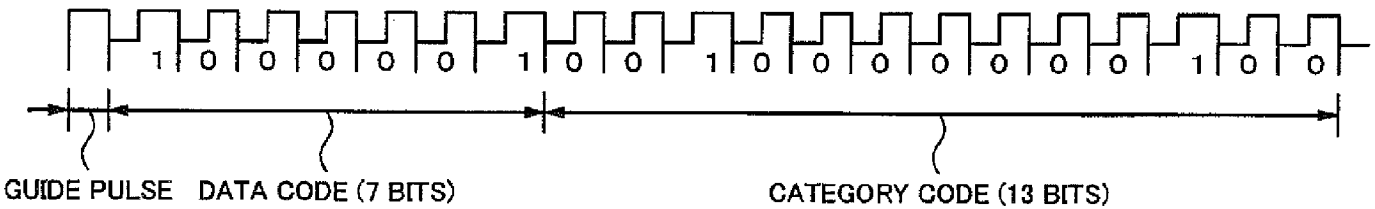
Fig. 2C (RELATED ART)
Figure 3:
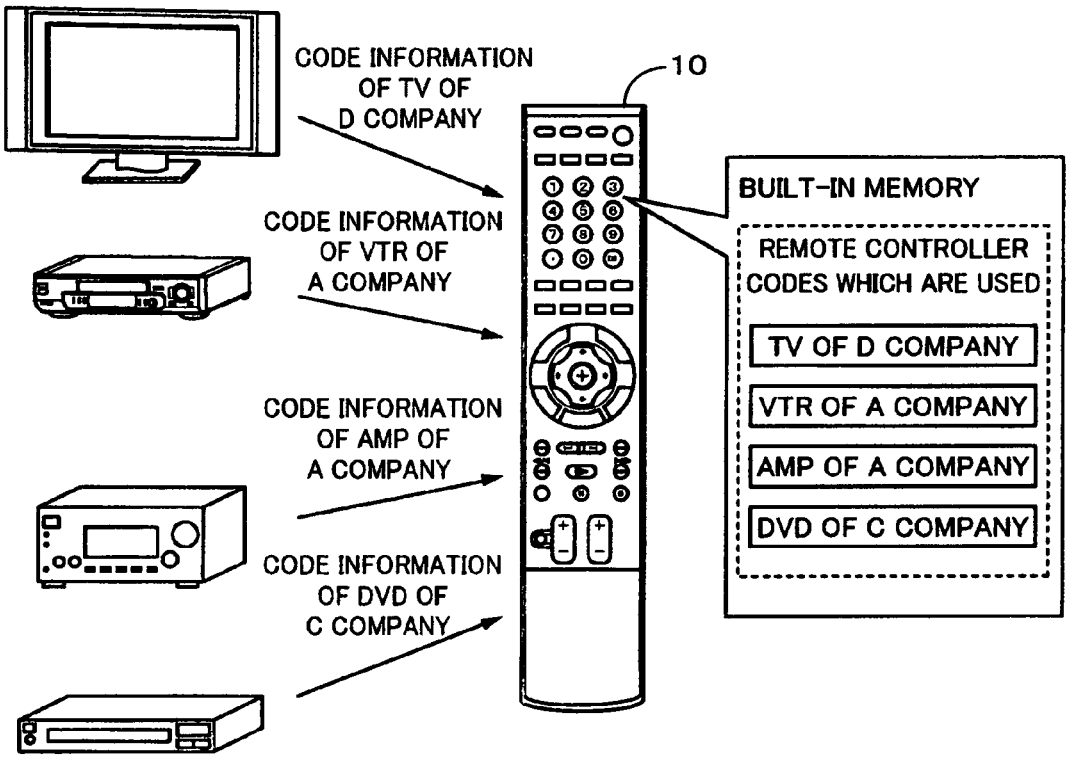
FIG. 3 is a schematic diagram for explaining a using form to which an embodiment of the invention can be applied.

An embodiment of the invention will be described hereinbelow with reference to the drawings. In the embodiment of the invention, as shown in FIG. 3, in a remote controller 10 which can operate one or a plurality of electronic apparatuses, radio communication which can make bidirectional communication is performed and code information in which an operation command as data for controlling has been described is received from a predetermined electronic apparatus. The operation commands are set into various keys on the basis of the received code information.

As electronic apparatuses which can be operated by using the remote controller 10, for example, there are: AV (Audio/Video) apparatuses such as television (TV) receiver, DVR (Digital Video Recorder), VCR (Video Cassette Recorder), VTR (Video Tape Recorder), satellite broadcasting (BS) tuner, cable television tuner, DVD (Digital Versatile Disc) recorder, BD (Blu-ray Disc) recorder, CD (Compact Disc) player, audio amplifier, and the like; and household appliances such as a refrigerator and the like.

Figure 4:
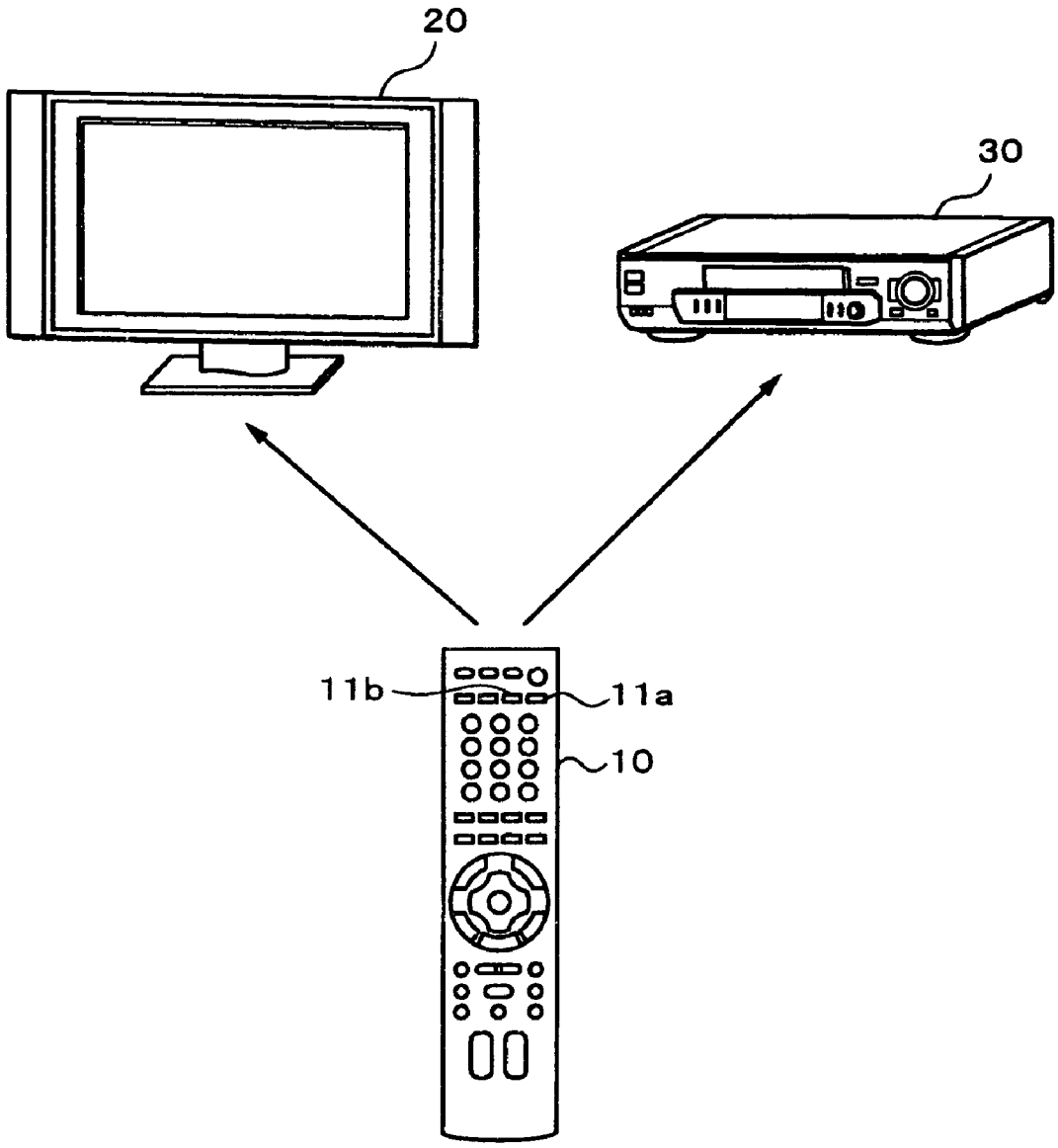
FIG. 4 is a schematic diagram showing an example of the using form to which the embodiment of the invention can be applied.

FIG. 4 shows an example of a using form to which the embodiment of the invention can be applied. FIG. 4 relates an the example of the case of operating a plurality of electronic apparatuses such as television (TV) receiver 20, VTR 30, and the like by using the remote controller 10.

The remote controller 10 is a remote controller which can operate, for example, one or a plurality of electronic apparatuses and a plurality of apparatus selecting keys 11*a* and 11*b* are provided. Different electronic apparatuses are made to correspond to the apparatus selecting keys 11*a* and 11*b*, respectively. By pressing either the apparatus selecting key 11*a* or 11*b*, the electronic apparatuses to be operated can be switched. In the example, for instance, when the apparatus selecting key 11*a* is pressed, the TV receiver 20 can be operated, and when the apparatus selecting key 11*b* is pressed, the VTR 30 can be operated.

The remote controller 10 operates the electronic apparatus by using the radio communication system which can make the bidirectional communication. In the case of operating the predetermined electronic apparatus by using the remote controller based on the radio communication system, first, it is necessary to execute a process called "pairing" for making the remote controller 10 and the electronic apparatus correspond in a one-to-one relational manner.

The pairing denotes that an ID (IDentification) is mutually exchanged between the remote controller 10 and the electronic apparatus. The ID is an address which can specify the electronic apparatus. An ID such as an MAC (Media Access Control) address or the like which is allocated upon manufacturing of the electronic apparatus, an address which is formed from the MAC address, or the like can be used as an ID.

For example, as shown in FIG. 4, a case where the pairing is executed between the remote controller 10 and the TV receiver 20 when the TV receiver 20 and the VTR 30 have been arranged in a room or the like will be considered. In this example, by pressing the apparatus selecting key 11*a* of the controller 10 for a long time, the controller 10 broadcasts (broadcast communicates) a message in which its own ID and a category code indicative of the TV receiver have been embedded. The TV receiver 20 and the VTR 30 receive the message.

In the TV receiver 20 and the VTR 30, whether or not the category code in the received message coincides with its own category code is discriminated. In the example, since the category code in the transmission message indicates the TV receiver, in the TV receiver 20, the coincidence of the category code is detected, and in the VTR 30, the coincidence of the category code is not detected.

The TV receiver 20 in which the coincidence of the category code has been detected transmits a response including its own ID to the remote controller 10. The VTR 30 in which the coincidence of the category code is not detected does not transmit the response to the remote controller 10. Therefore, the remote controller 10 receives only the response from the TV receiver 20 and registers the ID included therein as an electronic apparatus of a partner side.

As a category code showing the kind of electronic apparatus, an existing product code, for example, a JAN (Japanese Article Number) code or a code which has uniquely been defined may be used. Further, a maker code indicative of a maker name is used together with the category code and the kind of electronic apparatus may be specified in more detail.

A method of the pairing is not limited to the foregoing method but the pairing can be also performed by a method whereby, for example, the electronic apparatus which the user wants to operate by the remote controller 10 is set into a pairing standby mode and the remote controller 10 is set into a pairing mode. By using such a method, the pairing can be freely executed between the electronic apparatus which the user wants to operate and the remote controller 10 without transmitting the category code from the remote controller 10.

Since the operation command to operate the electronic apparatus is not preliminarily stored in the remote controller 10 according to the embodiment of the invention, actually, even if the pairing is established, it is difficult to operate the electronic apparatus. Therefore, after the pairing was established, it is necessary to make the operation command be associated with each operation key provided for the remote controller 10. For this purpose, in the embodiment of the invention, after the pairing was established, code information including the operation command of each operation key provided for the remote controller 10 is received from the electronic apparatus and the operation command is associated with each operation key on the basis of the received code information.

Figure 5:
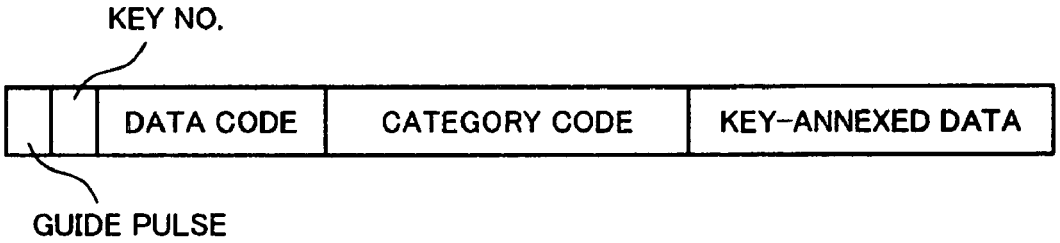
FIG. 5 is a schematic diagram showing an example of code information in the embodiment of the invention.

As shown in FIG. 5, a guide pulse, a key number, a data code, a category code, and key-annexed data are included in the code information which is transmitted from the electronic apparatus to the remote controller 10 after the pairing was established. The "guide pulse" is a signal indicative of the head of the code information. The "key number" is a number allocated to each operation key provided for the remote controller 10. The "key number" indicates an address of each operation key. The operation command which is data for controlling the electronic apparatus and is associated with the operation key to which the above key number has been allocated is described in the "data code". The "category code" is a code showing the category of the electronic apparatus such as TV receiver, DVD recorder, or the like. The "key-annexed data" indicates an index code which has been made to correspond to a name of the operation key to which the key number has been allocated or to a key icon which is associated with each operation key.

Figure 6:
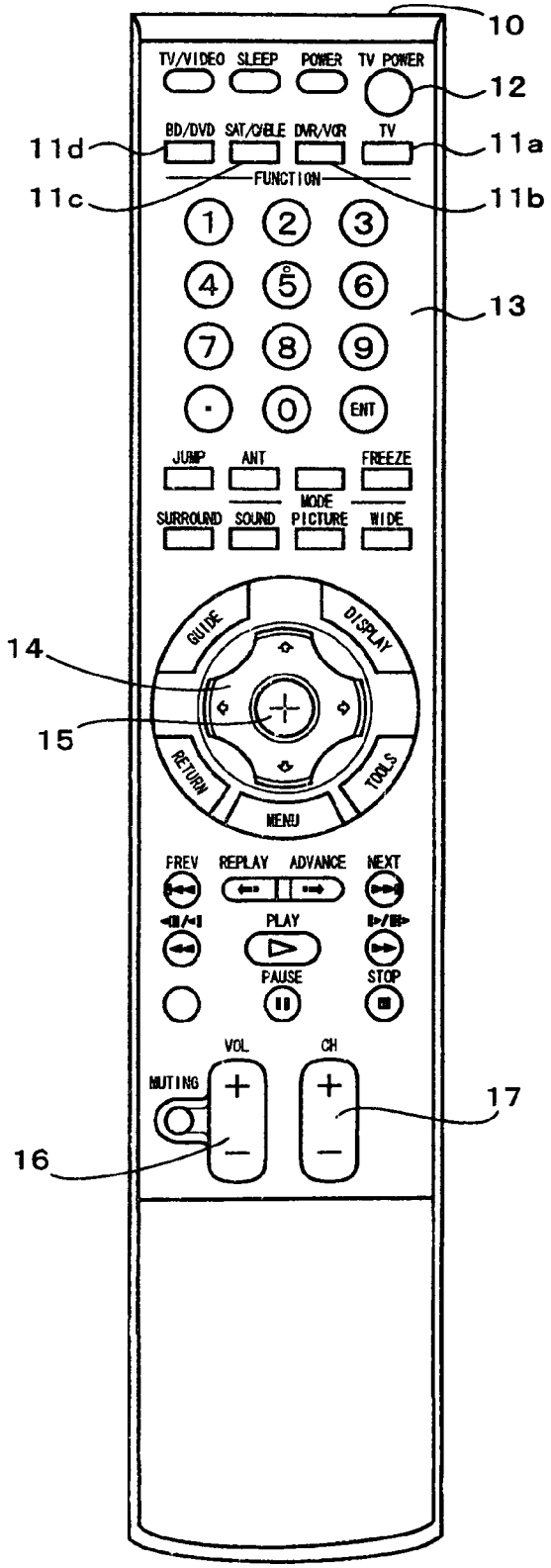
FIG. 6 is a schematic diagram showing an example of an external appearance of a remote controller according to the embodiment of the invention.

Subsequently, the remote controller 10 according to the embodiment of the invention will be described in detail. FIG. 6 shows an example of the external appearance of the remote controller 10. The remote controller 10 mainly has: apparatus selecting keys 11*a*, 11*b*, 11*c*, and 11*d*; a power key 12; a ten-key 13; a direction key 14; a decision key 15; a volume adjusting key 16; and a channel key 17. In the following description, if it is unnecessary to distinguish the kinds of keys, all keys are generally properly referred to as operation keys.

The apparatus selecting keys 11*a* to 11*d* are keys for selecting the electronic apparatus which is operated. The different electronic apparatuses are made to correspond to those selecting keys. The electronic apparatus which can be operated is switched by pressing any one of the apparatus selecting keys 11*a* to 11*d*. In the example shown in FIG. 6, for instance, the apparatus selecting key 11*a* is a TV receiver selecting key, the apparatus selecting key 11*b* is a DVR or VCR selecting key, the apparatus selecting key 11*c* is a BS (satellite broadcasting) tuner or cable TV tuner selecting key, and the apparatus selecting key 11*d* is a BD recorder or DVD recorder selecting key.

In the example, by pressing an arbitrarily one of the apparatus selecting keys 11*a* to 11*d* for a long time, the pairing with the electronic apparatus corresponding to the pressed apparatus selecting key is started.

Each of the apparatus selecting keys 11*a* to 11*d* is made by a self-illuminating type switch using, for example, an LED (Light Emitting Diode). By pressing each key, a position of each key is lit on or off or flickers, thereby enabling the apparatus selection to be displayed. For example, when any one of the apparatus selecting keys 11*a* to 11*d* is pressed, the position of the pressed apparatus selecting key is lit on, thereby displaying so as to indicate that the electronic apparatus corresponding to the pressed apparatus selecting key has been selected. If any one of the apparatus selecting keys 11*a* to 11*d* is pressed for a long time, for example, the position of the apparatus selecting key which has been pressed for a long time flickers, thereby displaying so as to indicate that the pairing is being executed.

The key numbers showing the addresses of the operation keys have been allocated to all of the operation keys provided for the remote controller 10. The operation command is associated with each operation key on the basis of the data code included in the code information of the key number which coincides with the allocated key number.

The operation commands which are different for the electronic apparatuses which were made to correspond to the apparatus selecting keys 11*a* to 11*d* are associated with the operation keys, respectively. By pressing any one of the apparatus selecting keys 11*a* to 11*d*, the electronic apparatus as an operation target is switched. When a predetermined operation key is pressed, the operation command associated with the key number of the pressed operation key is transmitted to the electronic apparatus and the electronic apparatus can be operated.

For example, if four apparatus selecting keys have been provided for the remote controller 10, four kinds of operation commands can be associated with the operation keys and the operation command which is transmitted to the electronic apparatus corresponding to the apparatus selecting key is switched in accordance with the pressed apparatus selecting key.

Figure 7:
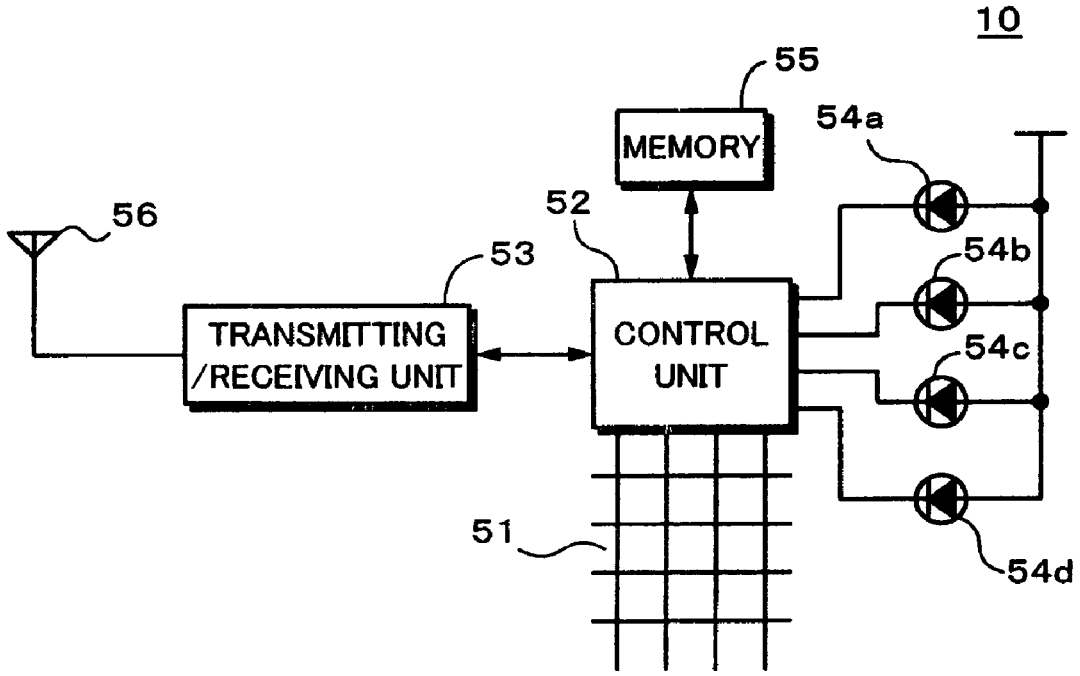
FIG. 7 is a block diagram showing a construction of an example of a main section of the remote controller according to the embodiment of the invention.

FIG. 7 shows a construction of an example of a main section of the remote controller 10. The remote controller 10 has: a key matrix 51; a control unit 52; a transmitting/receiving unit 53; display units 54*a*, 54*b*, 54*c*, and 54*d*; and a memory 55. The key matrix 51 detects which one of the operation keys provided for the remote controller 10 has been pressed and supplies a detection signal showing a detection result to the control unit 52. All of the operation keys such as apparatus selecting keys 11*a* to 11*d*, power key 12, ten-key 13, direction key 14, decision key 15, and the like provided for the remote controller 10 are included in the key matrix 51.

The control unit 52 is a microcomputer having a CPU (Central Processing Unit), a ROM (Read Only Memory), a RAM (Random Access Memory), and the like (not shown). The control unit 52 controls each unit of the remote controller 10 in accordance with a program which has previously been stored in the ROM by using the RAM as a work memory upon execution of the program. The memory 55 is a non-volatile memory such as an EEPROM (Electrically Erasable and Programmable ROM) or the like.

The control unit 52 receives the code information from the transmitting/receiving unit 53, which will be described hereinafter. The operation command described in the data code included in the received code information is associated with the operation key of the corresponding key number and stored into the memory 55. On the basis of the detection signal supplied from the key matrix 51, the control unit 52 reads out the operation command corresponding to the address of the detected operation key from the memory 55 and supplies it to the transmitting/receiving unit 53.

When it is detected based on the detection signal that any one of the apparatus selecting keys 11*a* to 11*d* has been pressed for a long time, the control unit 52 forms a message for the pairing with the electronic apparatus and supplies it to the transmitting/receiving unit 53. If the pairing is established, a response to the pairing from the electronic apparatus is received from the transmitting/receiving unit 53. When the control unit 52 receives the response to the pairing, the control unit 52 forms a request signal to receive all of the operation commands in the electronic apparatus in which the pairing has been established and supplies it to the transmitting/receiving unit 53.

The transmitting/receiving unit 53 makes radio communication with an external electronic apparatus through an antenna 56 in accordance with a predetermined protocol. The transmitting/receiving unit 53 broadcasts the message supplied from the control unit 52. The transmitting/receiving unit 53 also receives a response from the electronic apparatus to the message for the pairing and various kinds of data such as code information responsive to the request signal and supplies them to the control unit 52. Further, the transmitting/receiving unit 53 transmits the request signal and the various kinds of data such as operation commands and the like supplied from the control unit 52 to the electronic apparatus.

The display units 54*a*, 54*b*, 54*c*, and 54*d* display the selecting states of the electronic apparatuses which were made to correspond to the apparatus selecting keys 11*a*, 11*b*, 11*c*, and 11*d*, respectively. For example, the LED is used for each of the display units 54*a*, 54*b*, 54*c*, and 54*d* and is lit on or off or flickers based on the control of the control unit 52.

In the example, for instance, when any one of the apparatus selecting keys 11*a*, 11*b*, 11*c*, and 11*d* is pressed, the corresponding one of the display units 54*a*, 54*b*, 54*c*, and 54*d* is lit on. For example, if any one of the apparatus selecting keys 11*a*, 11*b*, 11*c*, and 11*d* is pressed for a long time, the corresponding one of the display units 54*a*, 54*b*, 54*c*, and 54*d* flickers.

Figure 8:
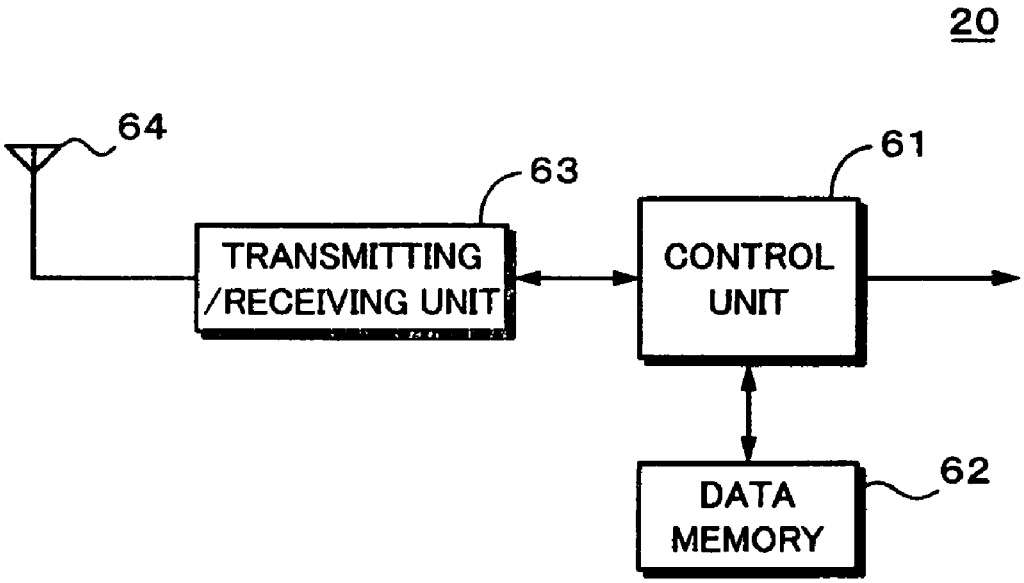
FIG. 8 is a block diagram showing a construction of an example of a main section of a television receiver.

FIG. 8 shows a construction of an example of a main section of the electronic apparatus, for example, the TV receiver 20. Only portions deeply concerned with the embodiment of the invention are shown here and an explanation of other portions are omitted. The TV receiver 20 mainly has a control unit 61, a data memory 62, and a transmitting/receiving unit 63.

The code information has been stored in the data memory 62. The code information is read out of the data memory 62 on the basis of control of the control unit 61, which will be described hereinafter.

The control unit 61 is a microcomputer having a CPU, a ROM, a RAM, and the like (not shown). The control unit 61 controls each unit of the TV receiver 20 (not shown) in accordance with a program which has previously been stored in the ROM by using the RAM as a work memory upon execution of the program. The control unit 61 controls each unit of the TV receiver 20 (not shown) so as to execute the operation based on the operation commands supplied from the remote controller 10 through the transmitting/receiving unit 63, which will be described hereinafter.

Upon pairing, the control unit 61 receives the message for the pairing from the transmitting/receiving unit 63, forms a response on the basis of the message, and supplies it to the transmitting/receiving unit 63. When the pairing is established, the control unit 61 receives a request signal from the transmitting/receiving unit 63, reads out the code information according to the request signal from the data memory 62, and supplies it to the transmitting/receiving unit 63.

The transmitting/receiving unit 63 makes radio communication with the remote controller 10 through an antenna 64 in accordance with a predetermined protocol. The transmitting/receiving unit 63 receives a message for the pairing transmitted from the remote controller 10 and various kinds of data such as request signal, operation command, and the like and supplies them to the control unit 61. The transmitting/receiving unit 63 also transmits a response to the pairing supplied from the control unit 61 and various kinds of data such as code information and the like to the remote controller 10.

The transmitting/receiving unit 53 of the remote controller 10 and the transmitting/receiving unit 63 of the electronic apparatus make bidirectional radio communication by the same radio communication system. For example, a physical layer of IEEE (Institute of Electrical and Electronic Engineers) 802.15.4 can be used as a radio communication system. IEEE 802.15.4 is a name of a short-range radio network standard called a PAN (Personal Area Network) or W (Wireless) PAN.

A communication rate of the above standard lies within a range from tens of kbps to hundreds of kbps and a communication distance lies within a range from tens of m (meters) to hundreds of m. The communication is made on a frame unit basis. One frame is set to a size of maximum 133 bytes constructed by a payload (0 to 127 bytes) and a header (6 bytes). A plurality of forms can be used as a transmitting/receiving method in this communication system. However, for example, in the embodiment of the invention, a method whereby a command is transmitted from the remote controller 10 to the electronic apparatus and the remote controller 10 receives a response from the electronic apparatus is used. The communication system is not limited to such an example but a more complicated transmitting/receiving method can be used.

Figure 9:
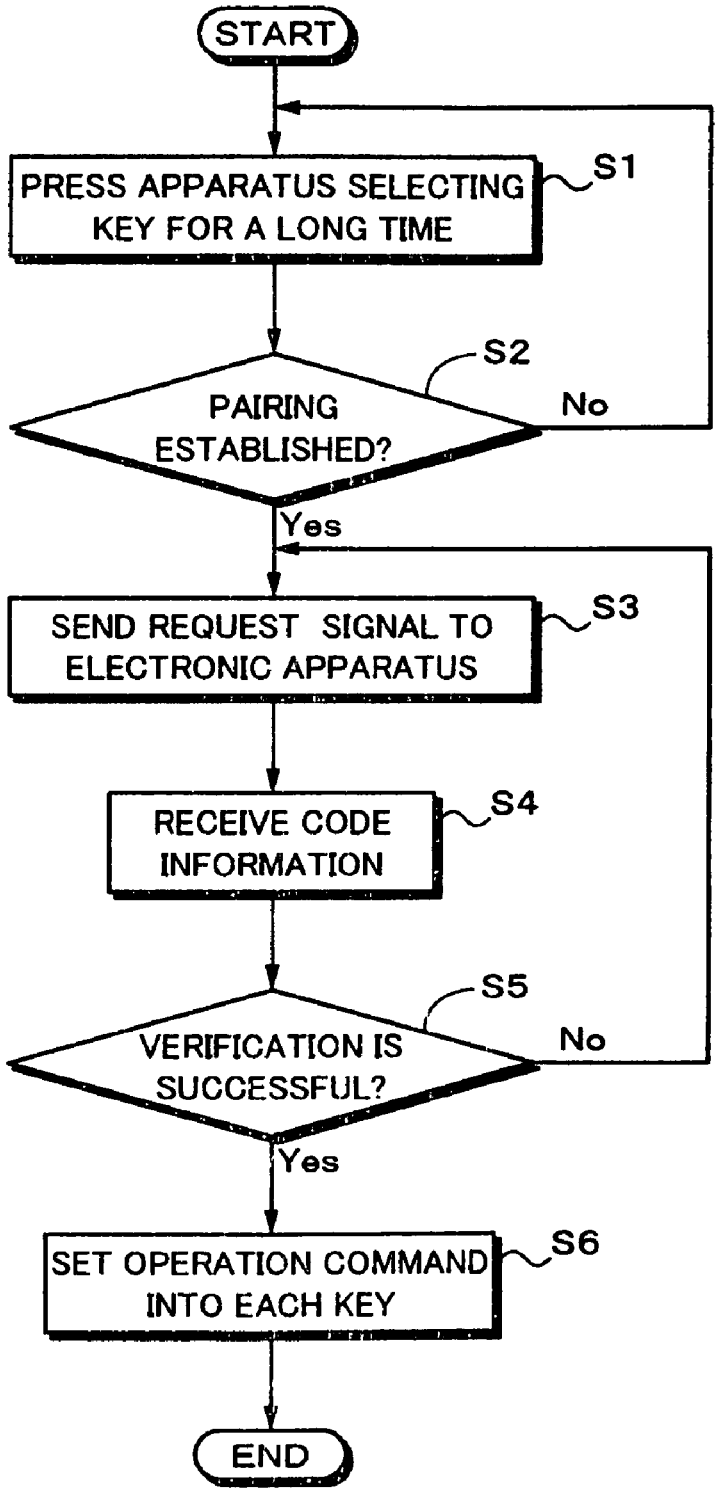
FIG. 9 is a flowchart showing a flow for a setting process of an operation command according to the embodiment of the invention.

A flow for a setting process of the operation command according to the embodiment of the invention will now be described with reference to a flowchart shown in FIG. 9. It is assumed that the following processes are executed under the control of the control unit 52 unless otherwise specified.

In step S1, by pressing any one of the apparatus selecting keys 11*a* to 11*d* for a long time, the pairing is started and the message in which the ID of the remote controller 10 and the category code of the electronic apparatus which the user wants to operate have been embedded is broadcasted to the outside through the antenna 56.

In step S2, whether or not the pairing with the electronic apparatus has been established is discriminated. If the response from the electronic apparatus to the message is received, it is determined that the pairing has been established. The ID included in the response is registered as an electronic apparatus on the partner side, and the processing routine advances to step S3. If the response to the message is not received, it is determined that the pairing has failed, and the processing routine is returned to step S1.

In step S3, the request signal to obtain the code information corresponding to the key numbers of all of the operation keys is transmitted to the electronic apparatus. In step S4, the code information responsive to the request signal is received.

In step S5, whether or not the code information received from the electronic apparatus has correctly been received is verified. If it is determined that the code information could be correctly received, step S6 follows and the operation command described in the data code included in the code information is stored into the memory 55 so as to be associated with the operation key of the corresponding key number. The process in step S6 is executed to all of the operation keys and a series of processes is finished.

If it is determined in step S5 that it is difficult to correctly receive the code information, the processing routine is returned to step S3 and the request signal is transmitted again.

Subsequently, the first modification of the embodiment of the invention will be described. Although the method of setting the operation commands in a lump into all of the operation keys provided for the remote controller 10 has been described in the above embodiment of the invention, there is a case where the user wants to individually set the operation command into the operation key. Therefore, in the first modification of the embodiment of the invention, the system is constructed so that the operation command can be individually set into the predetermined operation key.

The remote controller 10 according to the first modification of the embodiment of the invention can be realized by a construction similar to that according to the foregoing embodiment shown in FIG. 7 excluding the operation of the control unit 52 in the remote controller 10. Therefore, portions similar to those in the embodiment are designated by the same reference numerals and an explanation other than that of the operation of the control unit 52 is omitted here. It is also assumed that in the case of individually setting the operation command every operation key, the pairing has already been established between the remote controller 10 and the electronic apparatus, and its explanation is omitted here.

In the first modification of the embodiment of the invention, by pressing each operation key provided for the remote controller 10 for a long time, the operation command can be set every operation key.

When it is detected based on a detection signal from the key matrix 51 that the predetermined operation key has been pressed for a long time, the control unit 52 forms a request signal including the key number of the operation key which has been pressed for a long time and supplies it to the transmitting/receiving unit 53. The request signal is transmitted to the electronic apparatus through the transmitting/receiving unit 53 and the antenna 56.

The control unit 52 receives the code information from the electronic apparatus through the transmitting/receiving unit 53 and stores the operation command described in the data code included in the received code information into the memory 44 so as to be associated with the operation key of the corresponding key number.

Figure 10:
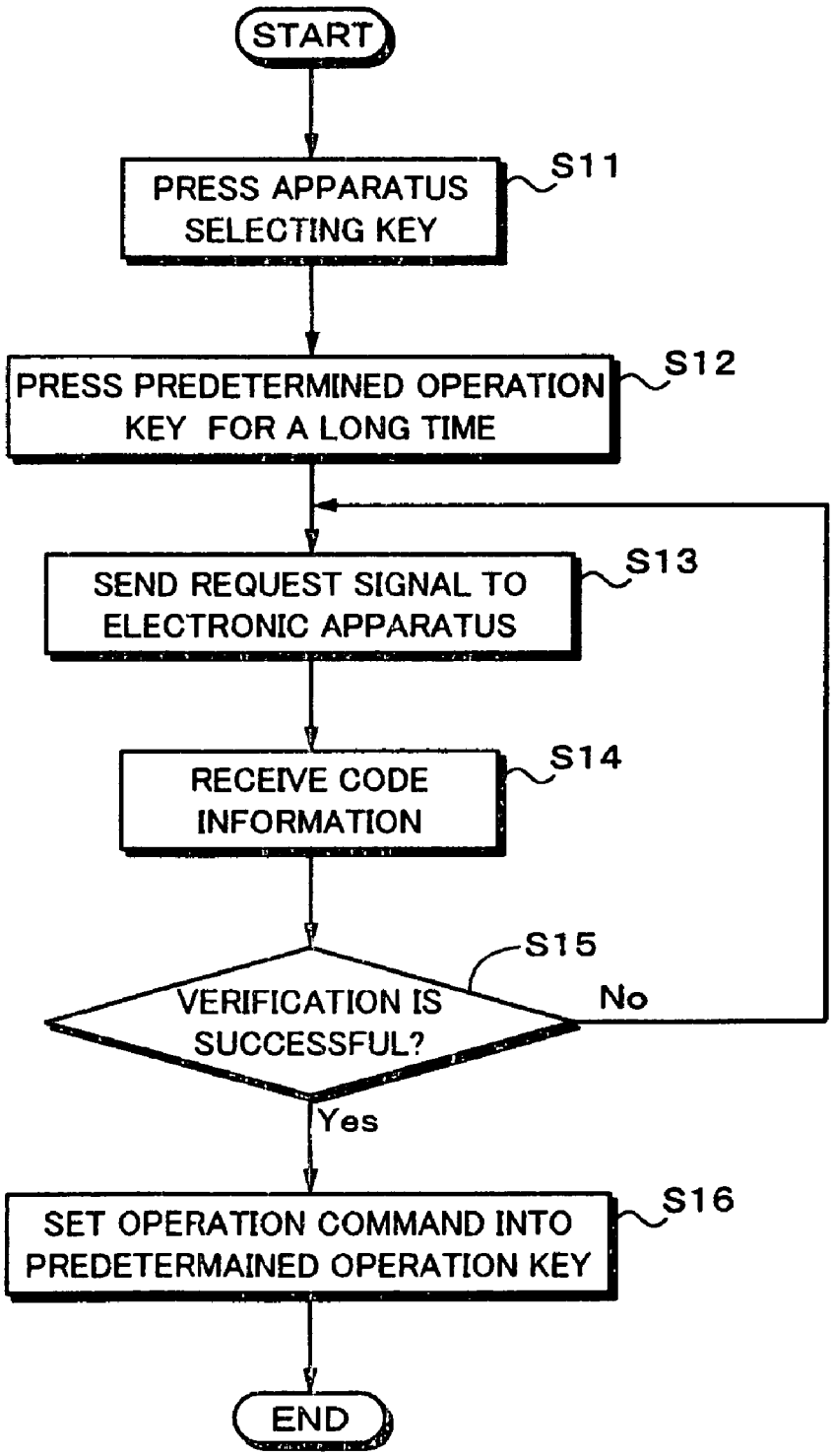
FIG. 10 is a flowchart showing a flow for a setting process of an operation command according to the first modification of the embodiment of the invention.

A flow for a setting process of the operation command according to the first modification of the embodiment of the invention will now be described with reference to a flowchart shown in FIG. 10. It is assumed that the following processes are executed under the control of the control unit 52 unless otherwise specified. An explanation will be made on the assumption that the pairing has already been established between the remote controller 10 and the electronic apparatus in the first modification of the embodiment of the invention.

In step S11, by pressing any one of the apparatus selecting keys 11*a* to 11*d*, the electronic apparatus serving as an operation target is switched. In step S12, by pressing a predetermined operation key for a long time, the request signal including the key number of the operation key which has been pressed for a long time is formed. In step S13, the request signal is transmitted to the electronic apparatus.

In step S14, in the electronic apparatus, the corresponding code information is transmitted on the basis of the key number included in the request signal and the code information transmitted from the electronic apparatus is received on the remote controller 10 side.

In step S15, whether or not the code information received from the electronic apparatus has correctly been received is verified. If it is determined that the code information could be correctly received, step S16 follows and the operation command described in the data code included in the code information is stored into the memory 55 so as to be associated with the operation key of the corresponding key number and a series of processes is finished.

If it is determined in step S15 that it is difficult to correctly receive the code information, the processing routine is returned to step S13 and the request signal is transmitted again.

As mentioned above, by pressing the predetermined operation key for a long time, the code information corresponding to the key number of the operation key pressed for a long time is received from the electronic apparatus and the operation command can be individually associated with each operation key.

Subsequently, the second modification of the embodiment of the invention will be described. In the second modification of the embodiment of the invention, in a remote controller having a touch panel display, code information is obtained from the electronic apparatus by the radio communication which can make the bidirectional communication and the operation command based on the code information is set into an icon of each operation key displayed on the touch panel display.

Figure 11A:
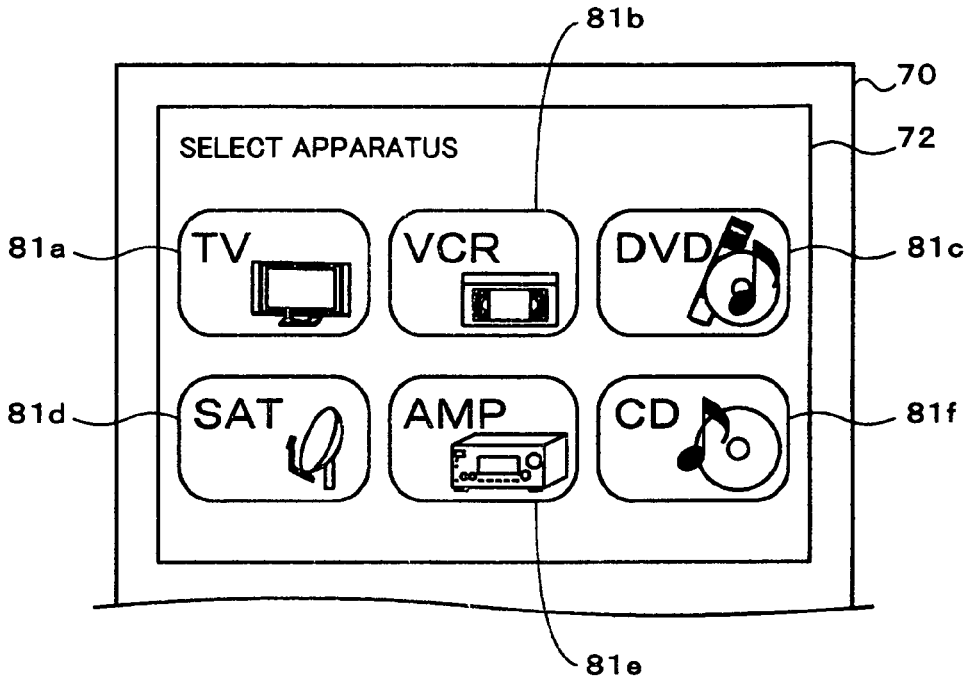
FIGS. 11A and 11B are schematic diagrams enlargedly showing a part of a remote controller according to a second modification of the embodiment of the invention.
Figure 11B:
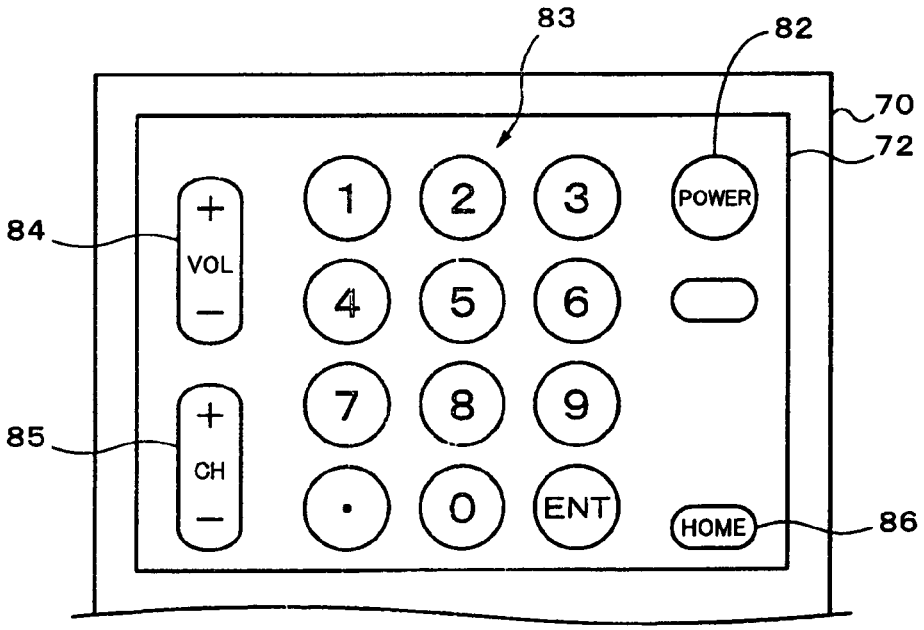

Each of FIGS. 11A and 11B enlargedly illustrates a part of an external appearance of a remote controller 70 according to the second modification of the embodiment of the invention. A touch panel display 72 is provided for the remote controller 70. As shown in FIG. 11A, an apparatus selecting display screen on which a plurality of icons for selecting the electronic apparatuses (hereinbelow, properly referred to as "apparatus selecting icons") 81*a*, 81*b*, 81*c*, 81*d*, 81*e*, and 81*f* have been arranged is displayed. The apparatus selecting icons displayed on the apparatus selecting display screen correspond to the apparatus selecting keys in the foregoing embodiment.

In the example shown in FIG. 11A, for example, the apparatus selecting icon 81*a* is a TV receiver selecting icon, the apparatus selecting icon 81*b* is a VCR selecting icon, the apparatus selecting icon 81*c* is a DVD recorder selecting icon, the apparatus selecting icon 81*d* is a BS (satellite broadcasting) tuner selecting icon, the apparatus selecting icon 81*e* is an audio amplifier selecting icon, and the apparatus selecting icon 81*f* is a CD player selecting icon, respectively.

In the apparatus selecting display screen shown in FIG. 11A, when a predetermined one of the apparatus selecting icons 81*a* to 81*f* is pressed, as shown in FIG. 11B, an operating display screen on which key icons of the operation keys ((hereinbelow, properly referred to as "operating icons") which can be operated by the selected electronic apparatus have been arranged is displayed. The operating icons displayed on the operating display screen correspond to the operation keys in the foregoing embodiment.

In the example shown in FIG. 11B, for example, a case where the TV receiver selecting icon has been pressed is illustrated. Various kinds of operating icons such as power icon 82, ten-key icon 83, volume adjusting icon 84, channel icon 85, and the like which are necessary to operate the TV receiver are displayed.

For example, a HOME icon 86 is displayed on the operating display screen. By pressing the HOME icon, the operating display screen is returned to the apparatus selecting display screen and the electronic apparatus to be operated can be selected again.

In the apparatus selecting display screen shown in FIG. 11A, by pressing any one of the apparatus selecting icons 81*a* to 81*f*, the pairing is started. When the pairing is established, the operation codes can be associated with all of the operating icons. In the apparatus selecting display screen shown in FIG. 11B, by pressing any one of the operating icons for a long time, the operation code can be individually associated with the pressed operating icon.

As mentioned above, in the second modification of the embodiment of the invention, the electronic apparatus to be operated is selected by pressing a proper one of the apparatus selecting icons displayed on the apparatus selecting display screen on the touch panel display 72. Various kinds of operations for the electronic apparatus can be executed by pressing the operating icons displayed on the operating display screen corresponding to the selected electronic apparatus.

Figure 12:
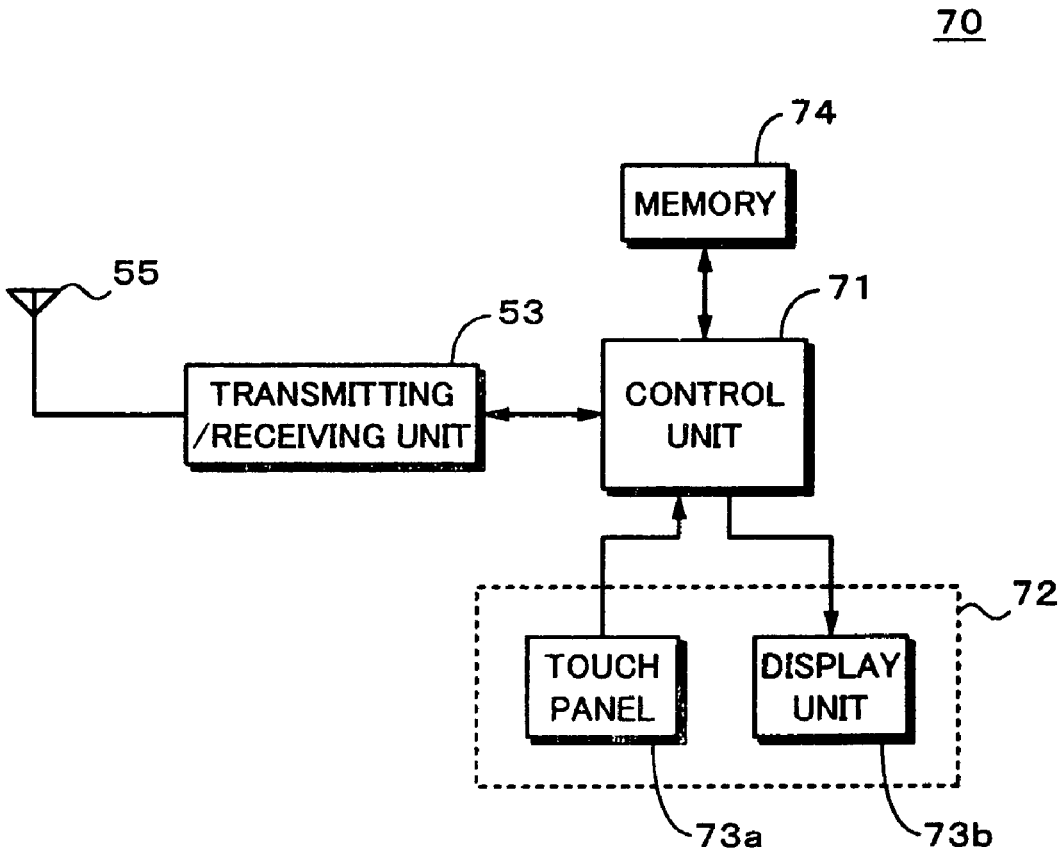
FIG. 12 is a block diagram showing a construction of an example of a main section of the remote controller according to the second modification of the embodiment of the invention.

FIG. 12 shows a construction of an example of a main section of the remote controller 70. The remote controller 70 has the transmitting/receiving unit 53, a control unit 71, the touch panel display 72, and a memory 74. With respect to the transmitting/receiving unit 53, since its construction is similar to that in the foregoing embodiment, it is designated by the same reference numeral and its detailed explanation is omitted here.

The touch panel display 72 has a construction in which a touch panel 73*a* has been laminated onto a display unit 73*b*. For example, an LCD (Liquid Crystal Display) can be used as a display unit 73*b*. The touch panel 73*a* is a transparent panel and an image displayed in the display unit 73*b* can be seen through the touch panel 73*a*.

As a specific construction of the touch panel 73*a*, for example, a panel of a pressure sensitive type in which a position where a contact pressure has been applied is detected or an electrostatic type in which a contact is detected as a change in electrostatic capacitance can be used. A touch panel of an infrared detecting system in which a number of sensors each constructed by an infrared light-emitting diode and a phototransistor have been provided can be also used.

While a finger is in contact with the touch panel 73*a*, the touch panel 73*a* supplies a coordinate signal corresponding to the touch position to the control unit 71. When the finger is come into contact with the touch panel 73*a*, the touch panel 73*a* supplies a touch signal to the control unit 71. When the finger is away from the touch panel 73*a*, the touch panel 73*a* supplies a release signal to the control unit 71.

The control unit 71 is a microcomputer having a CPU, a ROM, a RAM, and the like (not shown). The control unit 71 controls each unit of the remote controller 10 in accordance with a program which has previously been stored in the ROM by using the RAM as a work memory upon execution of the program. The memory 74 is a non-volatile memory such as an EEPROM or the like. A plurality of key icons corresponding to the operation keys such as apparatus selecting icons, operating icons, and the like have been stored in the memory 74.

The control unit 71 decodes the coordinate signal received from the touch panel 73*a* of the touch panel display 72 and forms XY position data. The control unit 71 controls the display of the display unit 73*b* on the basis of the XY position data and the touch signal and release signal received from the touch panel 73*a*.

The control unit 71 reads out a proper one of the apparatus selecting icons from the key icons stored in the memory 74 and forms the apparatus selecting display screen on which the apparatus selecting icons have been displayed as a list as shown in FIG. 11A. The formed apparatus selecting display screen is supplied to the touch panel display 72 and displayed on the display screen of the display unit 73*b*.

If it is detected on the basis of the XY position data, touch signal, and release signal that any one of the apparatus selecting icons has been pressed for a long time on the apparatus selecting display screen, the control unit 71 forms a message for the pairing with the electronic apparatus and supplies it to the transmitting/receiving unit 53. If the pairing has been established, a response to the pairing from the electronic apparatus is received from the transmitting/receiving unit 53. When the response to the pairing is received, the control unit 71 forms the request signal for receiving all of the operation commands in the electronic apparatus in which the pairing has been established and supplies it to the transmitting/receiving unit 53.

If it is detected on the basis of the XY position data, touch signal, and release signal that any one of the apparatus selecting icons has been pressed for a long time on the apparatus selecting display screen, the control unit 71 forms a request signal including the key number of the operating icon which has been pressed for a long time and supplies it to the transmitting/receiving unit 53. The request signal is transmitted to the electronic apparatus through the transmitting/receiving unit 53 and the antenna 56.

The control unit 71 receives the code information from the electronic apparatus through the transmitting/receiving unit 53, reads out the operating icon, from the memory 74, corresponding to an icon index code described in the key-annexed data included in the received code information and allocates the key number. The control unit 71 stores the operation command described in the data code included in the code information into the memory 74 so as to be associated with the operating icon of the corresponding key number. The control unit 71 forms an operating display screen on which the operating icons with which the operation commands were associated have been arranged. The formed operating display screen is supplied to the touch panel display 72 and displayed on the display screen of the display unit 73*b*.

If it is detected on the basis of the xY position data, touch signal, and release signal that a predetermined apparatus selecting icon has been pressed on the apparatus selecting display screen, the control unit 71 reads out the operating icon for operating the electronic apparatus corresponding to the pressed apparatus selecting icon from the memory 74 and forms the operating display screen on which the operating icons have been displayed as a list as shown in FIG. 11B. The formed operating display screen is supplied to the touch panel display 72 and displayed on the display screen of the display unit 73*b*.

If it is detected on the basis of the XY position data, touch signal, and release signal that the predetermined operating icon has been pressed on the operating display screen, the control unit 71 reads out the operation command corresponding to the pressed operating icon from the memory 74 and supplies it to the transmitting/receiving unit 53.

In the second modification of the embodiment of the invention, since the setting process of the operation commands for all of the operating icons and the setting process of the operation commands for the predetermined operating icon can be executed by pressing the operating icons in place of the operation keys in a manner similar to the foregoing embodiment and the first modification of the embodiment of the invention, their explanation is omitted here.

As mentioned above, in the embodiments of the invention and the first and second modifications of the embodiment, the bidirectional communication is made between the remote controller and the electronic apparatus, the operation command is directly obtained from the electronic apparatus, and the operation command is set into each operation key. Therefore, another device or the like for setting the operation command is unnecessary and the operation command can be easily set without setting an erroneous operation code into each operation key.

In the embodiments of the invention and the first and second modifications of the embodiment, since the operation command is received from the electronic apparatus and the received operation command is set into each operation key, it is sufficient that the memory having the capacity corresponding to the number of operation keys which can be set is prepared for the remote controller and the capacity of the built-in memory can be suppressed.

Further, in the embodiments of the invention and the first and second modifications of the embodiment, since the operation commands are previously stored into the electronic apparatus and the operation command is transmitted in accordance with the request from the remote controller, even if the user does not keep the source remote controller at hand, the operation command can be set into the remote controller.

Although the embodiments of the invention and the first and second modifications of the embodiment have been described above, the invention is not limited to the foregoing embodiments of the invention and the first and second modifications of the embodiment. It should be understood by those skilled in the art that various modifications, combinations, sub-combinations and alterations may occur depending on design requirements and other factors insofar as they are within the scope of the appended claims or the equivalents thereof. Although the invention has been described with respect to the example in which the TV receiver is used as an electronic apparatus which is operated by the remote controller 10, the invention is not limited to such an example but the invention can be also applied to the case of operating other electronic apparatuses such as VTR, DVD player, and the like.

For example, in the apparatus selecting display screen shown in FIG. 11A, although the example in which the six apparatus selecting icons 81*a* to 81*f* are displayed has been described, the invention is not limited to such an example but the system can be also constructed in such a manner that the user can increase or decrease the number of apparatus selecting icons as necessary.

What is claimed is:

1. A remote controller for operating another apparatus, comprising:

an operating unit having a plurality of operation keys to which different key numbers have been allocated and with which operation commands for operating said another apparatus have been associated;

a transmitting/receiving unit configured to communicate with said another apparatus by radio communication which can make bidirectional communication;

a storing unit configured to store the operation commands associated with said operation keys; and a control unit configured to read out the operation command according to the operation executed to said operating unit from said storing unit and transmit said operation command to said another apparatus through said transmitting/receiving unit, wherein said control unit forms a request signal for requesting code information including a key number allocated to a predetermined one of said operation keys and the operation command which corresponds to said key number, transmits said request signal to said another apparatus through said transmitting/receiving unit, receives the code information corresponding to said request signal from said another apparatus through said transmitting/receiving unit, and allows said operation command to be associated with the operation key to which the same key number as the key number included in said code information has been allocated and allows the operation command to be stored into said storing unit.

2. The remote controller according to claim 1, wherein said operating unit further has an apparatus selecting key configured to select the apparatus, and said control unit forms the request signal for requesting the code information corresponding to the key numbers allocated to all of the operation keys provided for said operating unit by pressing said apparatus selecting key for a predetermined time, receives the code information corresponding to said request signal from said another apparatus through said transmitting/receiving unit, and allows the operation commands to be associated with all of the operation keys on the basis of said code information.

3. The remote controller according to claim 2, further comprising a display unit configured to indicate a selecting state of the apparatus corresponding to said apparatus selecting key by light-on/light-off, and wherein said display unit is lit on when said apparatus selecting key is pressed, and flickers when said apparatus selecting key is pressed for a second predetermined time.

4. The remote controller according to claim 1, wherein said control unit forms the request signal for requesting the code information corresponding to the key number allocated to said operation key which has been pressed for a predetermined time by pressing the operation key provided for said operating unit, receives the code information corresponding to said request signal from said another apparatus through said transmitting/receiving unit, and allows the operation command to be associated with said operation key which has been pressed on the basis of said code information.

5. The remote controller according to claim 1, wherein said operating unit is a touch panel display, said storing unit further stores key icons as icons showing operation contents to said another apparatus, said code information further includes key-annexed data in which icon index data corresponding to said key icons has been described, and said control unit reads out the key icons, from said storing unit, shown by said icon index data described in said key-annexed data on the basis of said code information received from said another apparatus and allows said key icons to be arranged and displayed as said operation keys onto said touch panel display.

6. A remote control system comprising:

a remote controller having an operating unit having a plurality of operation keys to which different key numbers have been allocated and with which operation commands for operating another apparatus have been associated, a first transmitting/receiving unit configured to communicate with said another apparatus by radio communication which can make bidirectional communication, a first storing unit configured to store the operation commands associated with said operation keys, and a first control unit configured to read out the operation command according to the operation executed to said operating unit from said first storing unit and transmit said operation command to said another apparatus through said first transmitting/receiving unit; and an electronic apparatus having a second transmitting/receiving unit configured to communicate with said another apparatus by the radio communication which can make the bidirectional communication, a second storing unit configured to store code information including a predetermined key number and the operation command which corresponds to said key number, and a second control unit configured to control each of the units so as to execute an operation according to the operation command received from said another apparatus through said second transmitting/receiving unit, wherein when said remote controller and said electronic apparatus are connected by said first and second transmitting/receiving units, said remote controller forms a request signal for requesting said code information and transmits said request signal to said electronic apparatus, said electronic apparatus reads out the code information corresponding to said request signal from said second storing unit on the basis of said request signal received from said remote controller and transmits said code information to said remote controller, and said remote controller allows said operation command to be associated with the operation key to which the same key number as the key number included in said code information received from said electronic apparatus has been allocated and allows said operation command to be stored into said first storing unit.

7. A remote control method whereby when a remote controller configured to store operation commands associated with operation keys into a first storing unit, read out the operation command, from said first storing unit, corresponding to an operation executed to an operating unit having a plurality of operation keys to which different key numbers have been allocated and with which operation commands for operating another apparatus have been associated, and transmit said operation command to said another apparatus through a first transmitting/receiving unit which communicates therewith by radio communication which can make bidirectional communication and an electronic apparatus configured to store code information including a predetermined key number and the operation command which corresponds to said key number into a second storing unit and control each of the units so as to execute an operation corresponding to the operation commands received from said another apparatus through a second transmitting/receiving unit which communicates therewith by the radio communication which can make the bidirectional communication are connected by said first and second transmitting/receiving units, said remote controller forms a request signal for requesting said code information and transmits said request signal to said electronic apparatus, said electronic apparatus reads out the code information corresponding to said request signal from said second storing unit on the basis of said request signal received from said remote controller and transmits said code information to said remote controller, and said remote controller allows said operation command to be associated with the operation key to which the same key number as the key number included in said code information received from said electronic apparatus has been allocated and allows said operation command to be stored into said first storing unit.

* * * * *